US006674028B1

(12) United States Patent
Berton

(10) Patent No.: US 6,674,028 B1
(45) Date of Patent: Jan. 6, 2004

(54) MOTION ACTIVATED DECORATIVE ARTICLE

(76) Inventor: Andrew S. Berton, 1123 Mount Curve Ave., Minneapolis, MN (US) 55403-1128

( * ) Notice: Subject to any disclaimer, the term of this patent is extended or adjusted under 35 U.S.C. 154(b) by 71 days.

(21) Appl. No.: 10/000,334

(22) Filed: Oct. 23, 2001

Related U.S. Application Data

(60) Provisional application No. 60/242,361, filed on Oct. 23, 2000.

(51) Int. Cl.[7] ..... H01H 35/14
(52) U.S. Cl. ..... 200/61.52; 200/61.45 R
(58) Field of Search ..... 200/61.45 R–61.53, 200/292

(56) References Cited

U.S. PATENT DOCUMENTS

| | | | | | |
|---|---|---|---|---|---|
| 3,539,740 | A | * | 11/1970 | Isenor et al. | 200/61.45 R |
| 3,742,478 | A | * | 6/1973 | Johnson | 200/61.45 R |
| 4,001,185 | A | | 1/1977 | Mitsui et al. | 200/61.45 R |
| 4,135,067 | A | | 1/1979 | Bitko | 200/61.52 |
| 4,450,326 | A | * | 5/1984 | Ledger | 200/61.45 M |
| 4,628,160 | A | | 12/1986 | Canevari | 200/61.45 R |
| 4,660,715 | A | | 4/1987 | Anastos | 206/8 |
| 4,697,174 | A | | 9/1987 | Viator, Sr. | 340/689 |
| 4,756,222 | A | | 7/1988 | Armato | 84/1.01 |
| 4,898,060 | A | | 2/1990 | To | 84/95.2 |
| 4,980,575 | A | | 12/1990 | Schenkel | 307/121 |
| 5,070,755 | A | | 12/1991 | Carroll | 84/600 |
| 5,153,566 | A | * | 10/1992 | Yun | 200/61.45 R |
| 5,260,512 | A | | 11/1993 | Chomette et al. | 84/644 |
| 5,285,033 | A | | 2/1994 | Ipcinski | 200/61.52 |
| 5,317,304 | A | | 5/1994 | Choi | 340/571 |
| 5,332,876 | A | | 7/1994 | Romano et al. | 200/61.52 |
| 5,464,092 | A | | 11/1995 | Seeley | 206/217 |
| 5,465,197 | A | * | 11/1995 | Chien | 200/61.51 |
| 5,584,742 | A | | 12/1996 | Chen | 446/397 |
| 5,814,778 | A | * | 9/1998 | Schell | 200/61.45 R |
| 5,903,212 | A | | 5/1999 | Rodgers | 340/309.15 |
| 5,903,869 | A | | 5/1999 | Jacobson et al. | 704/272 |
| 5,926,099 | A | | 7/1999 | Unum | 340/686.1 |
| 6,005,204 | A | | 12/1999 | Choi et al. | 200/52 R |
| 6,028,275 | A | | 2/2000 | Jou | 200/61.52 |
| 6,121,877 | A | | 9/2000 | Johnson et al. | 340/571 |
| 6,125,190 | A | | 9/2000 | Wen | 381/124 |
| 6,198,396 | B1 | * | 3/2001 | Frank | 200/61.45 R |

* cited by examiner

*Primary Examiner*—Michael Friedhofer
(74) *Attorney, Agent, or Firm*—Kaardal & Leonard, LLP

(57) ABSTRACT

A motion activated decorative article that includes a housing, and a perceptible output generator for generating an output perceptible by a person, with the perceptible output generator generating the perceptible output upon receipt of a trigger signal. A triggering circuit triggers the perceptible output generator by generating the trigger signal and passing the triggering signal to the perceptible output generator upon receipt of an activating signal. A movement detection circuit detects movement of the housing and generates an activating signal upon detection of movement and passes the activating signal to the triggering circuit. One detection circuit embodiment includes a pair of conductors on a surface in a substantially equidistant relationship to each other and in a spiral path, and a conductor member movable across the surface for creating an electrical connection between the conductors when the conductor member contacts portions of both conductors simultaneously.

19 Claims, 9 Drawing Sheets

MOTION ACTIVATED DECORATIVE ARTICLE

CROSS REFERENCE TO RELATED APPLICATION

This application claims the benefit of U.S. Provisional Application No. 60/242,361, filed Oct. 23, 2000.

BACKGROUND OF THE INVENTION

1. Field of the Invention

The present invention relates to novelty items and more particularly pertains to a new motion activated decorative article that includes a relatively compact and inexpensive motion detecting circuit which is especially useful for incorporating into relatively small novelty items.

2. Description of the Prior Art

Novelty items activated by motion are known in the prior art. These novelty items generally incorporate some type of motion detecting means. As a preliminary matter, it should be understood that motion detecting means are distinguishable from orientation detecting means, since an object may move without changing its orientation. The known novelty items incorporating motion detecting means have tended to be relatively large in size (such as drinking glasses) in which size concerns are relatively less critical. However, in the case of many types of novelty items, it is highly desirable that the embodiment of the novelty items be as compact in size as possible, and also that the novelty item be as relatively inexpensive in cost as possible due to the relative price sensitivity of consumers for these items. Therefore, the relative size and weight of the motion detecting means in the novelty item becomes a more significant issue as the type of novelty item becomes smaller. For example, novelty items that are intended to be mounted on a vertical surface, such as an appliance door, need to be especially compact and light in weight in order to be maintained on the vertical surface, particularly when the mounting of the novelty item on the vertical surface is to be accomplished with relatively inexpensive and weak mounting means such as a small magnet, a moderately aggressive pressure sensitive adhesive, or hook and loop fasteners.

Because of the size and weight constraints on these types of novelty items, it is believed that use of the known motion detecting means and the circuitry associated therewith is very limited for small novelty items. Therefore, it is believed that there exists a need for a more compact motion detecting sensor and circuitry to enable these components to be effectively incorporated into smaller novelty items.

SUMMARY OF THE INVENTION

In view of the foregoing disadvantages inherent in the known types of novelty items incorporating motion detecting means that are present in the prior art, the present invention provides a new motion activated decorative article that includes a relatively compact and inexpensive motion detecting circuit which is especially useful for incorporating into relatively small novelty items.

To attain this, the present invention generally comprises a housing, and a perceptible output generator for generating an output perceptible by a person, with the perceptible output generator generating the perceptible output upon receipt of a trigger signal. A triggering circuit triggers the perceptible output generator by generating the trigger signal and passing the triggering signal to the perceptible output generator upon receipt of an activating signal. A movement detection circuit detects movement of the housing and activates the triggering circuit, with the movement detection circuit generating an activating signal upon detection of movement of the housing and passing the activating signal to the triggering circuit. One detection circuit embodiment includes a pair of conductors on a surface in a substantially equidistant relationship to each other and in a spiral path, and a conductor member movable across the surface for creating an electrical connection between the conductors when the conductor member contacts portions of both conductors simultaneously.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that my conception of the invention, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION

Figure 1:
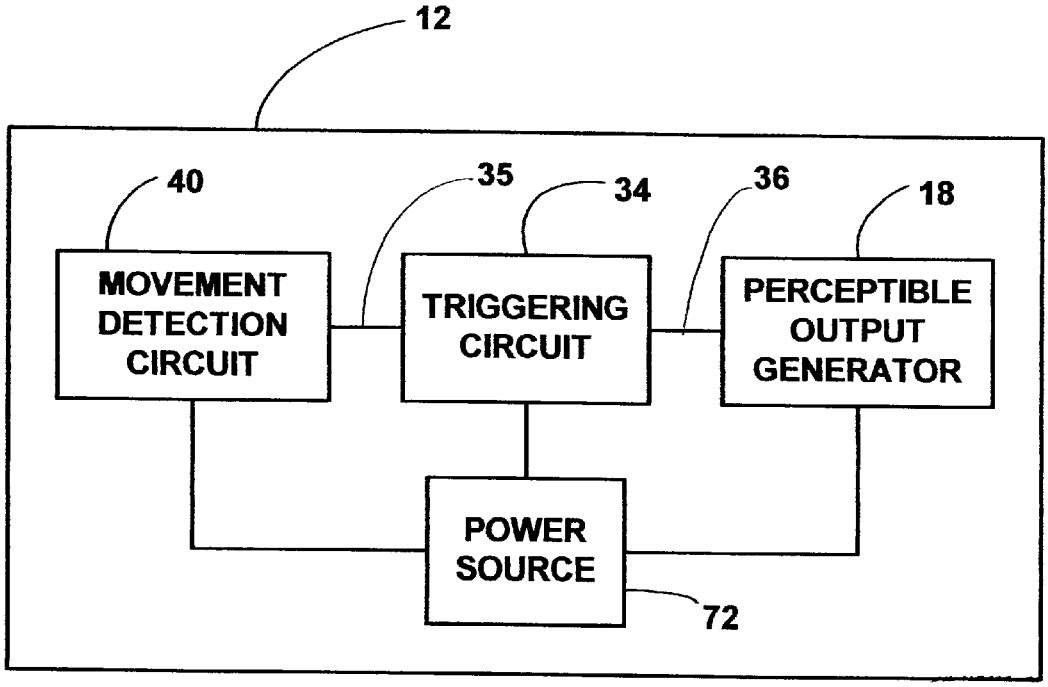
FIG. 1 is a schematic diagrammatic view of a new motion activated decorative article according to the present invention.
Figure 2:
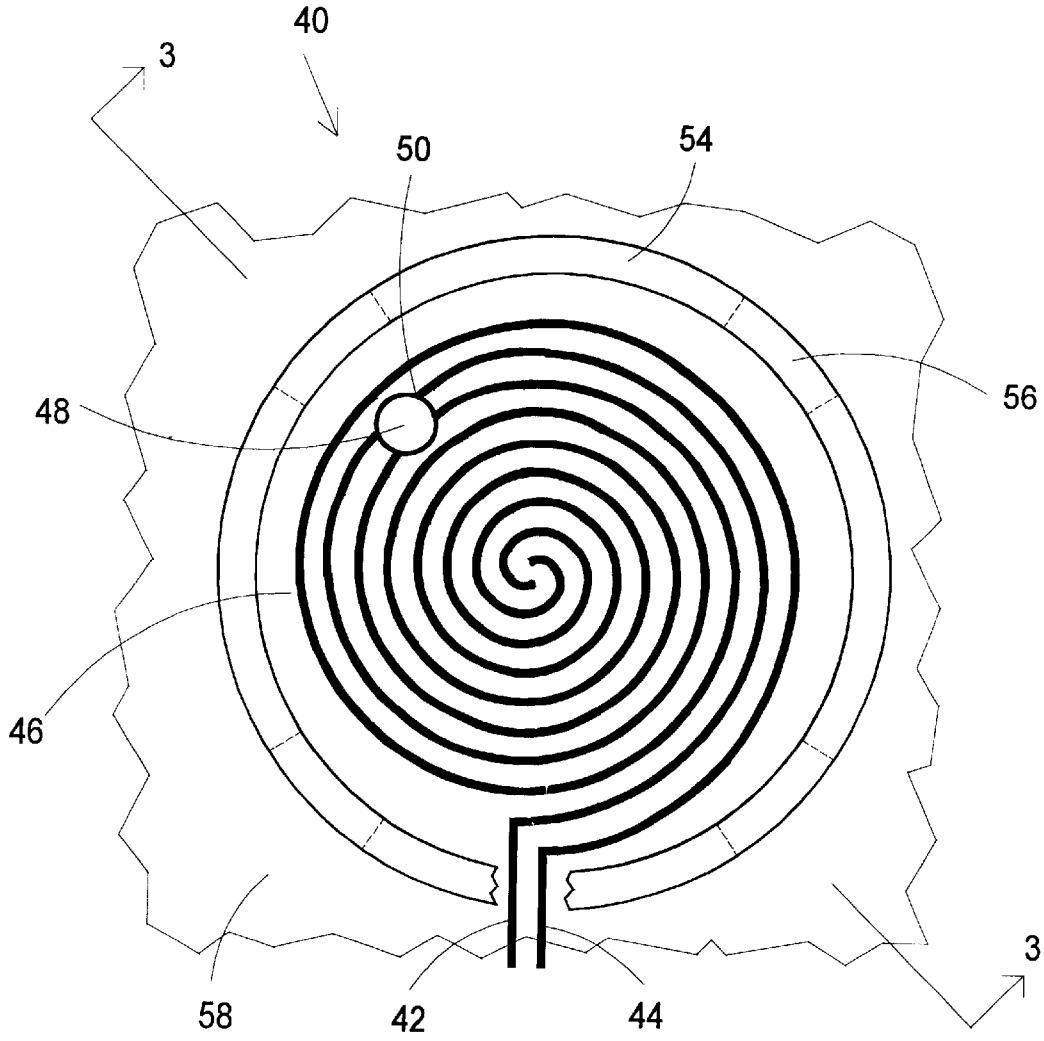
FIG. 2 is at schematic plan view of one of the embodiment of the movement detection circuit of the present invention particularly illustrating the pair of conductors and the conductor member surrounded by the perimeter wall, with the top wall removed to reveal detail.
Figure 3:
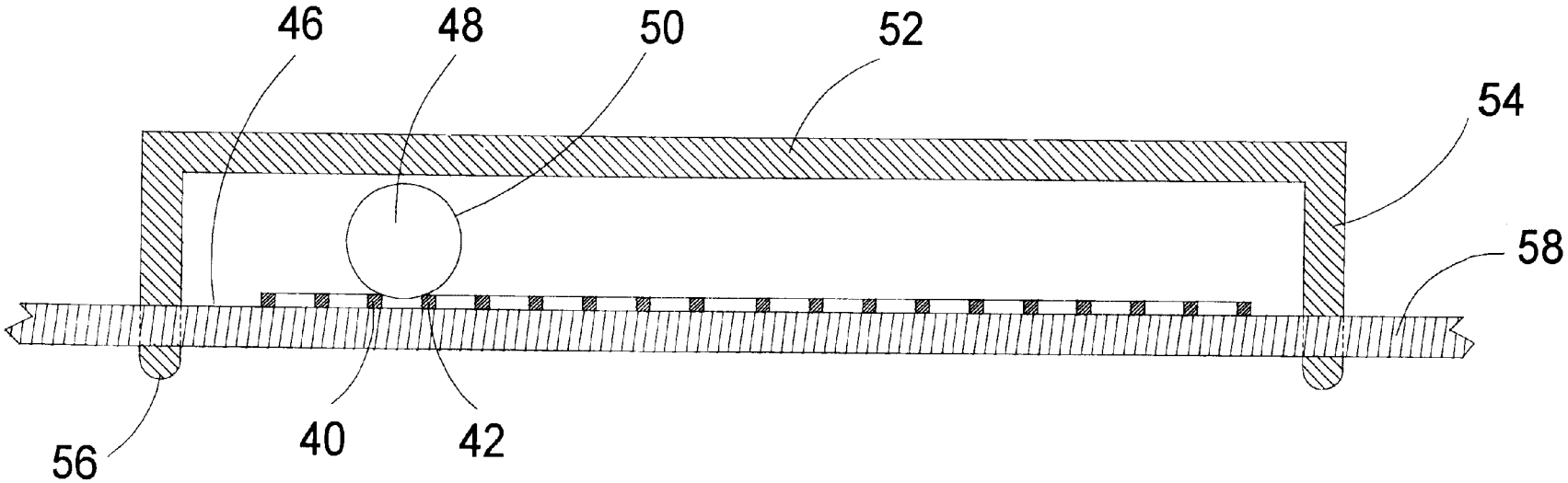
FIG. 3 is a schematic sectional view of the movement detection circuit embodiment taken along line 3—3 of FIG. 2, with the protrusion of the conductors from the surface being somewhat exaggerated for increased clarity.

With reference now to the drawings, and in particular to FIGS. 1 through 11 thereof, a new motion activated decorative article embodying the principles and concepts of the present invention and generally designated by the reference numeral 10 will be described.

As best illustrated in FIGS. 1 through 11, the motion activated decorative article 10 generally comprises a movement detection circuit 40, a triggering circuit 34, and a perceptible output generator 18.

The motion activated decorative article of the invention may include a housing 12 that has a back 14 and a front 16. In one preferred embodiment, at least the front 16 of the housing may have a decorative contoured shape, such as, for example, a shape resembling a head of a being, although virtually any desired decorative shape may be used.

The perceptible output generator 18 of the invention generates an output that may be perceived by at least one of the senses of a person, such as for example, by the eye or by the ear of the person. The perceptible output generator 18 may generate the perceptible output upon receipt of a trigger signal from the output 36 of the triggering circuit. The perceptible output may include an audible output that may be heard by a person, and the perceptible output generator may thus generate an audible sound. In such an embodiment, the perceptible output generator may comprise a sound generating circuit 20 for generating signals that are convertible into audible sounds. Optionally, the sound generating circuit 20 may comprise a voice generator circuit 22 for generating signals convertible into voice sounds. Optionally, the sound generating circuit 20 may comprise a melody reproducing circuit 24 for generating signals convertible into musical sounds. The perceptible output generator 18 may also include a sound transducer 26 for receiving signals from the sound generating circuit and converting the signals into audible sounds. In one embodiment of the sound transducer, the transducer 26 may comprise a speaker 28. Optionally, the transducer 26 may comprise a piezo transducer 30.

The perceptible output may also include a visible output that may be seen by a person, and the perceptible output generator 18 may generate a visible light as the visually perceptible output. The perceptible output generator may comprise a light driver circuit 31 and a light 32. Optionally, the light 32 may comprise a light emitting diode.

It should be understood that the perceptible output generator of an article of the invention is not limited to the types of outputs set forth above, or just one or even two or three types of outputs, and thus an article of the invention may have a combination of outputs, such as audible and visual outputs. Optionally, the outputs may be positioned in locations on the housing that correspond to the decorative contouring of the front of the housing, such as positioning a light output at a location corresponding to the nose of a face formed on the front of the housing, and/or positioning a speaker in an opening corresponding to the position of the mouth on the face formed on the housing.

The invention includes a triggering circuit 34 for triggering the perceptible output generator 18. The triggering circuit 34 may include means for detecting receipt of an activating signal by the triggering circuit. The triggering circuit may include means for passing an initial activating signal and suppressing any additional activating signals received by the triggering circuit within a predetermined time period after the initial activating signal is received. The triggering circuit may include means for generating a trigger signal and transmitting the trigger signal to the perceptible output generator 18.

A significant feature of the invention is the movement detection circuit 40 for detecting movement of the housing and activating the triggering circuit. The movement detection circuit 40 may be mounted on the housing 12 so that the movement detection circuit moves with the housing. The movement detection circuit 40 may generate an activating signal upon detection of movement of the housing, and the activating signal may be passed to the triggering circuit 34. Preferably, the activating signal is generated even if the movement not accompanied by a change in orientation of the housing. One embodiment of the movement detection circuit 40 is a trembler switch.

In greater detail, the movement detection circuit 40 may comprise a pair of conductors 42, 44 that are formed on a surface 46. The pair of conductors 42, 44 may be elongated and relatively long compared to the width of the conductor. The pair of conductors 42, 44 preferably extend in a substantially equidistant (e.g., parallel) relationship to each other on the surface. Each of the conductors may extend in a spiral path so that the parallel conductors spiral about a center in a series of substantially concentric spiral segments having gradually increasing diameters. Preferably, each of the spiraled conductors 42, 44 has at least two spiral segments. Optionally, the conductors may comprise gold, or be gold plated, to facilitate conduction.

The movement detection circuit 40 may also include a conductor member 48 that is movable across the surface 46 for creating an electrical connection between the pair of conductors 42, 44 when the conductive member 48 contacts a portion of both of the pair of conductors simultaneously. The conductor member 48 may have a conductive outer surface 50, which may comprise a conductive metal, such as, for example, gold. The outer surface 50 of the conductor member 40 may have a substantially spherical outer surface for facilitating rolling movement of the conductor member over the surface.

The movement detection circuit 40 may include a holding structure for holding the conductor member 48 in contact with the surface 46 during movement of the conductor member, and may permit movement of the conductor member in a direction substantially parallel to the surface and may block movement of the conductor member out of contact with the surface. The holding structure may comprise a top wall 52 spaced from the surface 46 and a perimeter wall 54 extending between the top wall and the surface. Optionally, a plurality of tabs 56 may extend from the perimeter wall 54 and may extend through the surface 46 for anchoring the top and perimeter walls to the surface.

Preferably, the surface 46 and the pair of conductors 42, 44 form a substantially flat surface that does not substantially hinder free rolling movement of the conductor member 48 over the surface and the pair of conductors. Movement of the movement detection circuit 40 causes rolling movement of the conductor member 48 over the surface and over multiple locations on the pair of conductors, thus creating a conductive link between the conductors at the locations of contact. The rolling movement may cause repetitive and intermittent connection and disconnection of the conductors.

Significantly, the surface 46 may comprise a surface of a printed circuit board 58, and the pair of conductors each may, comprise a conductive trace etched on the surface of the printed circuit board. Illustratively, the surface occupied by the conductors may be as small as approximately 0.5 inches (approximately 1.3 cm), and the conductor member may have a diameter of approximately 3/32 inches (approximately 2.4 mm). Thus, the motion detection circuit may be made extremely compact. Optionally, the tabs 56 of the holding structure may extend into and even through the printed circuit board 58. The walls of the holding structure may comprise a non-conductive material, such as, for example, plastic, although conductive materials, such as, for example, a metal, may also be used.

The invention may also comprise an attachment structure 60 for attaching the housing 12 on a support such as, for example, a vertical surface. The attachment structure, or at least a portion thereof, may be mounted on the housing 12, and may be mounted on the back 14 of the housing so that the front of the housing is directed outwardly away from the support. In one embodiment, the attachment structure 60 includes a single component 64. Optionally, the single component attachment structure may comprise a removable attachment structure such as, for example, a magnet. Optionally, the single component attachment structure may comprise a relatively more permanent attachment structure such as, for example, a pressure sensitive adhesive. In another embodiment, the attachment structure 60 may include two components 66, 68, with a first one 66 of the two components being mounted on the housing and a second one 68 of the two components being for mounting on the support 70. The first and second components may be relatively permanently attachable together, but more preferably are removably attachable together. In one embodiment of the attachment structure, the first and second components comprise a hook and loop fastening assembly, with the first component 66 comprising either the hook component or the loop component of a hook and loop fastening assembly, and the second component 68 comprising the complementary component to the hook component or the loop component of the first component 66.

The invention may also comprise a power source 72 for supplying power to the various electrical components of the article of the invention. The power source 72 may be located in the housing 12. Illustratively, the power source may comprise two or three alkaline button cell batteries.

Figure 4:
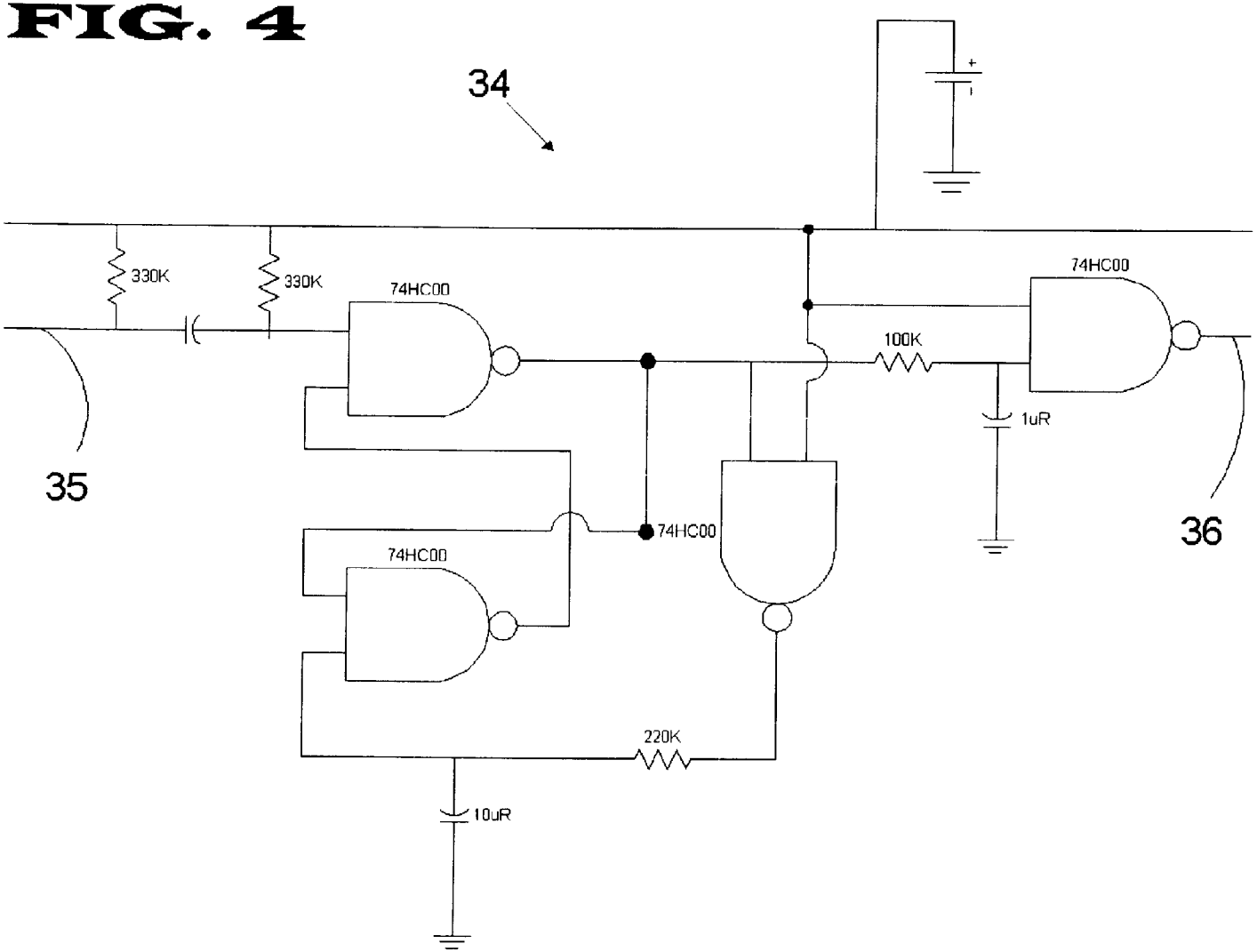
FIG. 4 is a schematic diagrammatic view of one embodiment of triggering circuit of the present invention.

In greater detail, one illustrative triggering circuit 34 is schematically shown in FIG. 4. An output 35 of the movement detection circuit 40 is coupled to the input of the triggering circuit 34 in a manner so that only changes in the current flowing through the movement detection circuit are passed to the remainder of the triggering circuit. This may be accomplished by an AC coupling between the output of the movement detection circuit and a first portion of the triggering circuit, which may comprise a flip-flop circuit. The flip-flop circuit may be formed by a pair of cross coupled NAND gates (illustratively, 74HC00 NAND gates). Movement of the movement detection circuit produces a change in the output of the detection circuit, and as a result the flip-flop is set. The output of the flip-flop of this first portion of the triggering circuit is differentiated and inverted by a second portion of the triggering circuit, which may comprise an additional NAND gate. The output 36 of the second portion may be a low-going trigger pulse, and the pulse may have a duration of, for example, 100 milliseconds. Optionally, a high-going trigger pulse may be produced using a differentiating circuit driven by an opposite output of the flip-flop circuit. The flip-flop remains set for a period of time, such as for approximately two seconds, so that further changes in the output of the movement detection circuit are prevented from passing through the flip-flop while the flip-flop is set. The flip-flop is then reset by a third portion of the triggering circuit, which may comprise a resistor-capacitor (RC) circuit (illustratively, a 220K resistor and a 10 micro Farad electrolytic capacitor) so that the time constant of the RC circuit determines the period over which the flip-flop is set and the output of the movement detection circuit is prevented from passing through the flip-flop. The output of the second portion is passed to the perceptible output generator. Optionally, if the perceptible output generator includes a non-retriggerable circuit, it may not be necessary to inhibit the output of the movement detection circuit, and the output of the detection circuit may be AC coupled to drive a transistor used to charge (or discharge) a capacitor to provide the trigger pulse output from the triggering circuit.

Figure 5:
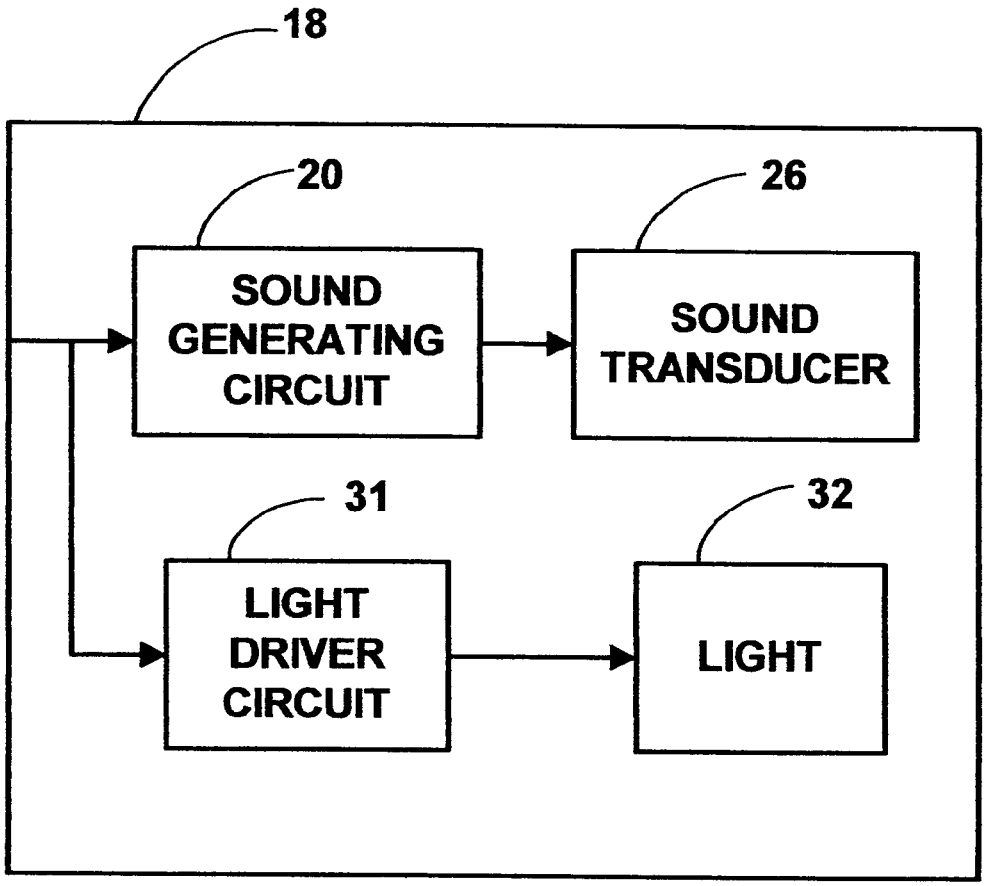
FIG. 5 is a schematic diagrammatic view of one embodiment of the perceptible output generator of the present invention.
Figure 6:
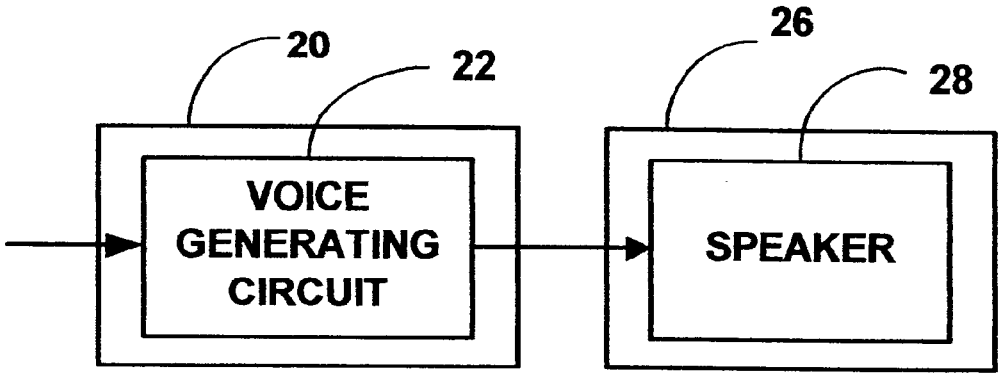
FIG. 6 is a schematic diagrammatic view of a more detailed depiction of one embodiment of the perceptible output generator of FIG.
Figure 7:
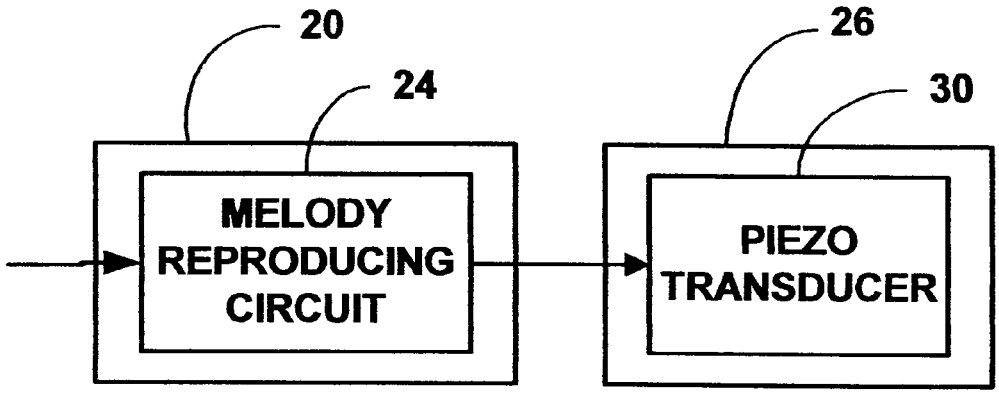
FIG. 7 is a schematic diagrammatic view of a more detailed depiction of one embodiment of the perceptible output generator of FIG. 5.
Figure 8:
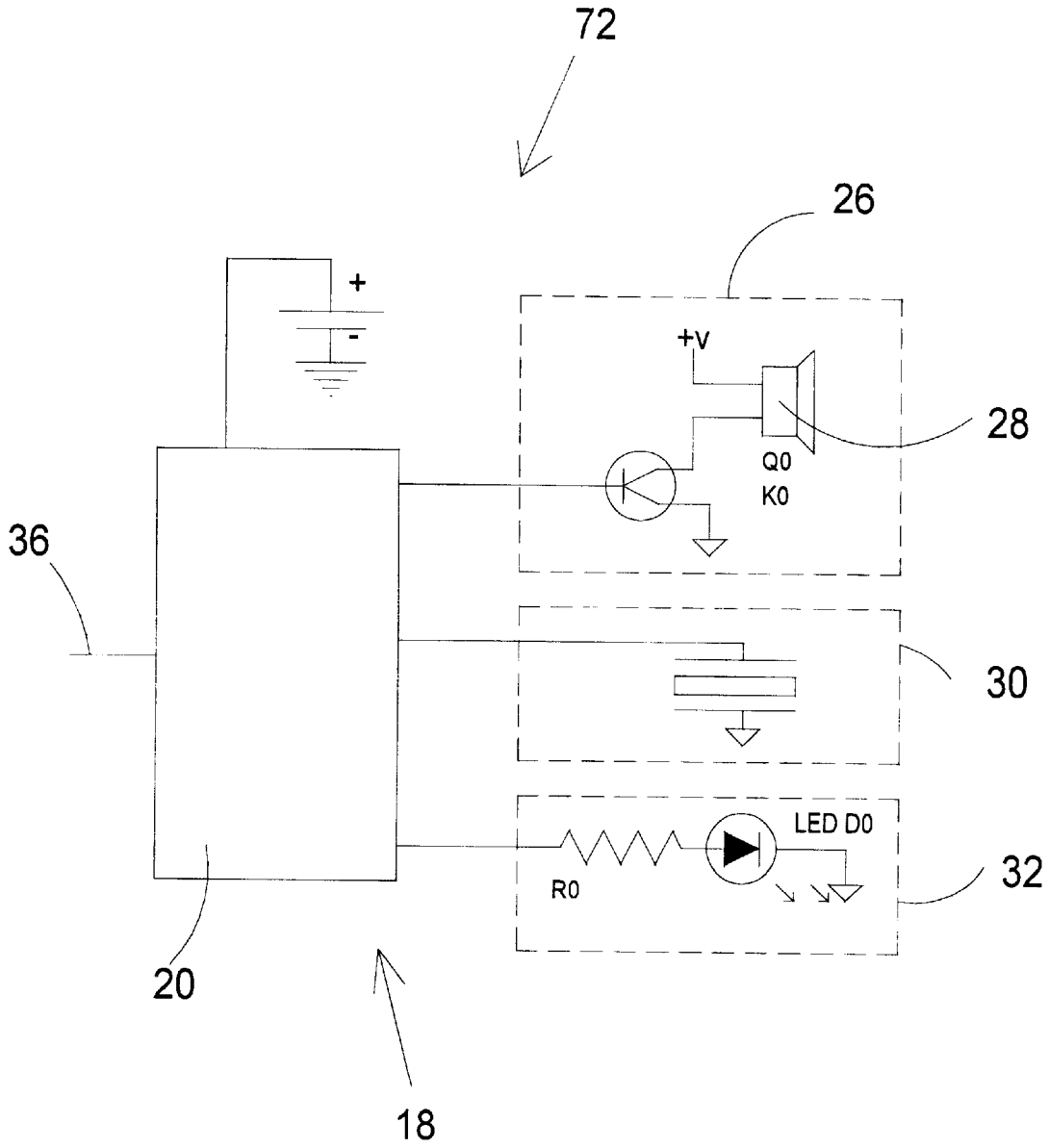
FIG. 8 is a schematic diagrammatic view of a more detailed depiction of one embodiment of the perceptible output generator of FIG. 5.
Figure 9:
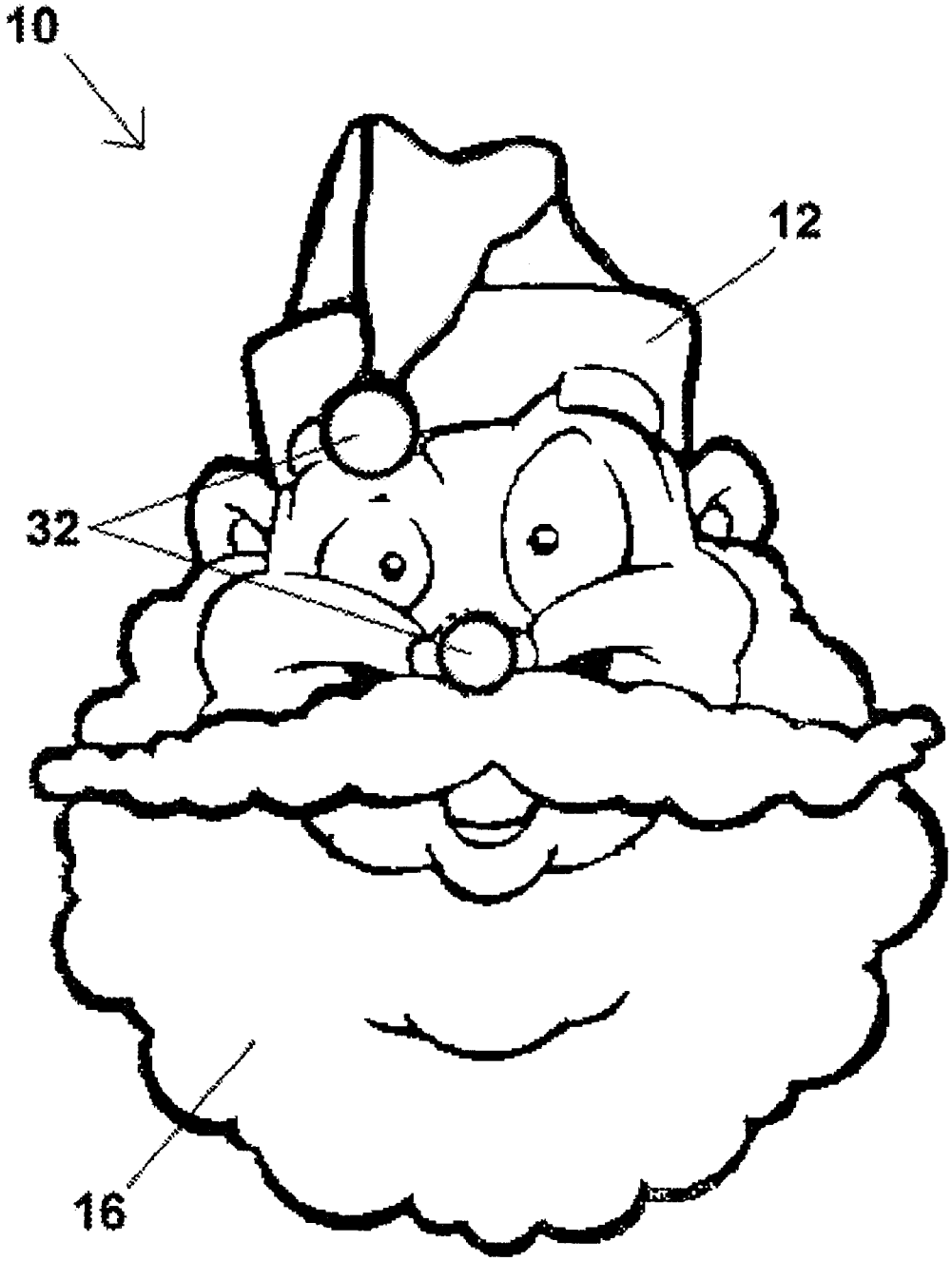
FIG. 9 is a schematic front view of one illustrative housing of the present invention.
Figure 10:
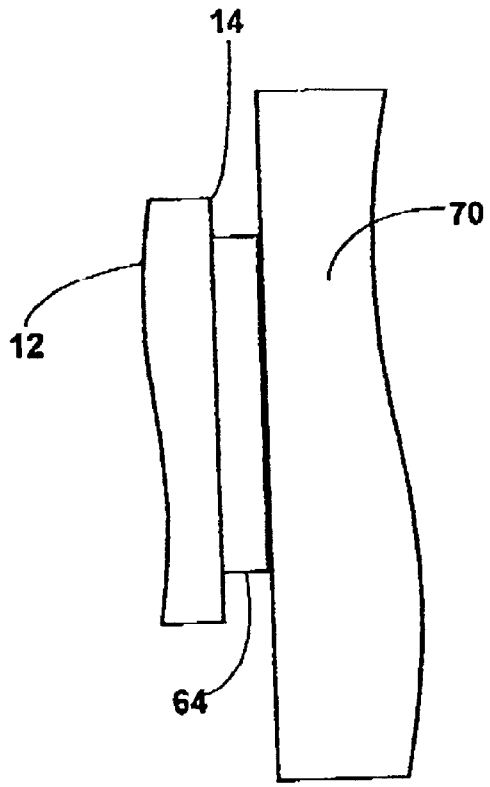
FIG. 10 is a schematic side view of a rear portion of an illustrative housing of the present invention showing a single component attachment structure.
Figure 11:
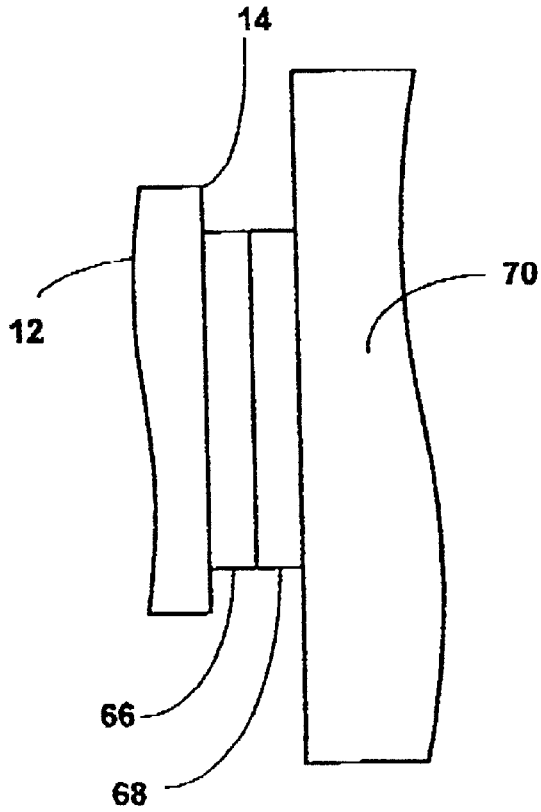
FIG. 11 is a schematic side view of a rear portion of an illustrative housing of the present invention showing a two component attachment structure.

One illustrative embodiment of the perceptible output generator is shown in FIG. 5, and may include the voice generator circuit 22 that generates signals which cause the sound transducer 26 (such as a speaker 28) to emanate sounds that simulate, for example, a human voice. The duration of the signals generated by the circuit 22 may be approximately 2.5 to approximately 3 seconds, although other durations may be employed. Some suitable voice generator circuits include a Winbond W528S03 available from Winbond Electronics Corporation America, 2727 North First Street, San Jose, Calif. 95134; a Holtek HT81003 or HT812D0 available from Holtek Technology Corp., 48531 Warm Springs Boulevard, Suite 413, Fremont, Calif. 94539; a Realtek RTS 3100C available from Realtek Semiconductor Corp., No. 2, Industry E. Rd. IX, Science-based Industrial Park, Hsinchu 300, Taiwan; and a SunPlus SPS02D4 available from Sunplus Technology Co., Ltd., 19, Innovation Road I, Science-based Industrial Park, Hsinchu 300, Taiwan. Other voice generator circuits may be used.

One illustrative embodiment of the perceptible output generator includes the melody reproducing circuit 24 that generates signals which cause the sound transducer 26 (such as a piezo transducer 30) to emanate musical sounds. Some suitable melody reproducing circuits include a SunPlus SPD01A, a Realtek RTS901 or RTS950B, and a High Tech Chips HTC750 available from High Tech Chips, Inc, 631E Windsor Rd #8, Glendale, Calif. 91205.

As noted above, one embodiment of the perceptible output generator includes the light driver circuit 31 that drives a light. The light driver circuit may comprise the light being driven directly from the triggering circuit output, through a current limiting resistor, or through a driver transistor. The duration of the illumination of the light may be approximately 2 seconds. One suitable light driver circuit flashes the light, and may include a High Tech Chip HTC150, although other circuits may be used It should be appreciated from the foregoing that the motion detecting circuitry, and thus the novelty items incorporating the foregoing, may be made extremely compact and light in weight, and thus is highly suitable for small novelty items where size and bulk is a concern.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motion activated decorative article comprising:

a housing;

a perceptible output generator for generating an output perceptible by a person, the perceptible output generator generating the perceptible output upon receipt of a trigger signal;

a triggering circuit for triggering the perceptible output generator, the triggering circuit generating the trigger signal and passing the triggering signal to the perceptible output generator upon receipt of an activating signal;

a movement detection circuit for detecting movement of the housing and activating the triggering circuit, the movement detection circuit generating an activating signal upon detection of movement of the housing and passing the activating signal to the triggering circuit, wherein the movement detection circuit includes a pair of conductors formed on a surface and wherein the movement detection circuit includes a conductor member movable across the surface for creating an electrical connection between the pair of conductors when the conductor member contacts both of the pair of conductors simultaneously; and holding means for holding the conductor member in contact with the surface during movement of the conductor member, the holding means permitting movement of the conductor member in a direction substantially parallel to the surface and blocking movement of the conductor member out of contact with the surface.

2. The article of claim 1 wherein the pair of conductors are elongated and extend in a substantially equidistant relationship to each other.

3. The article of claim 1 wherein each of the conductors extends in a spiral path.

4. The article of claim 1 wherein the conductor member has a conductive outer surface.

5. The article of claim 1 wherein the conductor member has a substantially spherical outer surface for facilitating rolling of the conductor member over the surface such that movement of the movement detection circuit causes rolling movement of the conductor member over the surface and over multiple locations on the pair of conductors.

6. The article of the claim 1 wherein the holding means comprises a substantially circular perimeter wall extending between the top wall and the surface and about the pair of conductors.

7. The article of claim 1 wherein the holding means comprises a top wall spaced from the surface.

8. The article of claim 1 wherein the surface and the pair of conductors form a substantially flat surface that does not hinder free rolling movement of the conductor member over the surface and pair of conductors.

9. The article of claim 1 wherein the surface comprises a surface of a printed circuit board and each of the pair of conductors comprises a trace etched on the surface of the printed circuit board.

10. A motion activated decorative article comprising:

a housing;

a perceptible output generator for generating an output perceptible by a person, the perceptible output generator generating the perceptible output upon receipt of a trigger signal;

a triggering circuit for triggering the perceptible output generator, the triggering circuit generating the trigger signal and passing the triggering signal to the perceptible output generator upon receipt of an activating signal; and a movement detection circuit for detecting movement of the housing and activating the triggering circuit, the movement detection circuit generating an activating signal upon detection of movement of the housing and passing the activating signal to the triggering circuit;

attachment means mounted on an exterior of the housing for attaching the housing on a support.

11. The article of claim 10 wherein the attachment means includes a single component on the exterior of the housing.

12. The article of claim 10 wherein the attachment means includes two components, a first one of the components being mounted on the exterior of the housing and a second one of the components for mounting on a support, the first and second components being removably attachable together.

13. The article of claim 1 wherein the perceptible output comprises an audible output and the perceptible output generator generates an audible sound, the perceptible output generator comprising a sound generating circuit for generating signals convertible into audible sounds and a sound transducer for converting signals from the sound generating circuit into audible sound.

14. The article of claim 1 wherein the perceptible output comprises a visible output and the perceptible output generator generates a visible light.

15. The article of claim 1 wherein the triggering circuit comprises:

means for detecting receipt of an activating signal by the triggering circuit;

means for passing an initial said activating signal and suppressing any additional said activating signals received by the triggering circuit within a predetermined time period after the initial activating signal; and means for generating the trigger signal and transmitting the trigger signal to the perceptible output generator.

16. A movement detection circuit comprising:

a surface;

a pair of conductors formed on the surface, the pair of conductors being elongated and extending in a substantially equidistant relationship to each other, each of the conductors extending in an adjacent relationship along a spiral path;

a conductor member movable across the surface for creating an electrical connection between the pair of conductors when the conductor member contacts both of the pair of conductors simultaneously, the conductor member having a conductive outer surface, the conductor member having a substantially spherical outer surface for facilitating rolling of the conductor member over the surface such that movement of the movement detection circuit causes rolling movement of the conductor member over the surface and over multiple locations on the pair of conductors; and holding means for holding the conductor member in contact with the surface during movement of the conductor member, the holding means permitting movement of the conductor member in a direction substantially parallel to the surface and blocking any movement of the conductor member out of contact with the surface;

wherein the surface and the pair of conductors form a substantially flat surface that does not hinder free rolling movement of the conductor member over the surface and pair of conductors;

wherein the pair of conductors are elongate, substantially uniformly wide, and substantially coextensive with each other along their respective lengths on the spiral path.

17. The movement detection circuit of the claim 16 wherein the holding means includes a substantially circular perimeter wall extending about the spiral path of the pair of conductors.

18. The movement detection circuit of claim 16 wherein the surface comprises a surface of a printed circuit board and each of the pair of conductors comprises a trace etched on the surface of the printed circuit board.

19. A motion activated decorative article comprising:

a housing having a back and a front, the front having a contoured shape resembling a head of a being;

a perceptible output generator for generating an output perceptible by a person, the perceptible output generator generating the perceptible output upon receipt of a trigger signal;

wherein the perceptible output includes an audible output and the perceptible output generator generates an audible sound, the perceptible output generator comprising:

a sound generating circuit for generating signals convertible into audible sounds; and a sound transducer for converting signals from the sound generating circuit into audible sound;

wherein the perceptible output includes a visible output and the perceptible output generator generates a visible light, the perceptible output generator comprising a light driver circuit and a light, the light comprising a light emitting diode;

a triggering circuit for triggering the perceptible output generator, the triggering circuit comprising:

means for detecting receipt of an activating signal by the triggering circuit;

means for passing an initial activating signal and suppressing any additional activating signals received by the triggering circuit within a predetermined time period after the initial activating signal;

means for generating a trigger signal and transmitting the trigger signal to the perceptible output generator;

a movement detection circuit for detecting movement of the housing and activating the triggering circuit, the movement detection circuit being mounted on the housing, the movement detection circuit generating an activating signal upon detection of movement of the housing, the movement detection circuit comprising:

a pair of conductors formed on a surface, the pair of conductors being elongated and extending in a substantially equidistant relationship to each other, each of the conductors extending in a spiral path, each of the spiral conductors having at least two spirals, the pair of conductors being elongate and substantially coextensive with each other along their respective lengths on the spiral path;

a conductor member movable across the surface for creating an electrical connection between the pair of conductors when the conductor member contacts both of the pair of conductors simultaneously, the conductor member having a conductive outer surface, the conductor member having a substantially spherical outer surface for facilitating rolling movement of the conductor member over the surface;

holding means for holding the conductor member in contact with the surface during movement of the conductor member, the holding means permitting movement of the conductor member in a direction substantially parallel to the surface and blocking movement of the conductor member out of contact with the surface;

wherein the surface and the pair of conductors form a substantially flat surface that does not hinder free rolling movement of the conductor member over the surface and pair of conductors such that movement of the movement detection circuit causes rolling movement of the conductor member over the surface and over multiple locations on the pair of conductors;

wherein the surface comprises a surface of a printed circuit board and the pair of conductors each comprise a trace etched on the surface of the printed circuit board;

attachment means for attaching the housing on a support, the attachment means being mounted on the housing; and a power source for supplying power.

* * * * *